US009972902B2

(12) United States Patent
Hamabe

(10) Patent No.: US 9,972,902 B2
(45) Date of Patent: May 15, 2018

(54) ANTENNA DEVICE AND ELECTRONIC DEVICE

(71) Applicant: Panasonic Intellectual Property Management Co., Ltd., Osaka (JP)

(72) Inventor: Taichi Hamabe, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days. days.

(21) Appl. No.: 14/887,134

(22) Filed: Oct. 19, 2015

(65) Prior Publication Data

US 2016/0126635 A1 May 5, 2016

(30) Foreign Application Priority Data

Nov. 4, 2014 (JP) ..... 2014-223887
Aug. 26, 2015 (JP) ..... 2015-166938

(51) Int. Cl.
*H01Q 9/04* (2006.01)
*H01Q 1/48* (2006.01)
*H01Q 1/22* (2006.01)

(52) U.S. Cl.
CPC ..... *H01Q 1/48* (2013.01); *H01Q 1/2283* (2013.01)

(58) Field of Classification Search
CPC ..... H01Q 9/0414
USPC ..... 343/700 MS
See application file for complete search history.

(56) References Cited

U.S. PATENT DOCUMENTS

2003/0092420 A1 5/2003 Sugimoto et al.
2003/0197573 A1 10/2003 Kato
2006/0170597 A1 8/2006 Kurashima et al.
2006/0214869 A1 9/2006 Kuroda
2007/0176828 A1 8/2007 Kuroda
2008/0122705 A1 5/2008 Kurashima et al.
2008/0272972 A1 11/2008 Kanno et al.
(Continued)

FOREIGN PATENT DOCUMENTS

JP 2003-188625 7/2003
JP 2003-309404 10/2003
(Continued)

*Primary Examiner* — Jessica Han
*Assistant Examiner* — Jae Kim
(74) *Attorney, Agent, or Firm* — McDermott Will & Emery LLP

(57) ABSTRACT

An antenna device includes: a ground upper layer substrate of a dielectric substrate forming a first ground part and a second ground part disposed at a predetermined distance from the first ground part; a ground lower layer substrate of a dielectric substrate forming a third ground part and a fourth ground part disposed at a predetermined distance from the third ground part; and an inner layer substrate of a dielectric substrate forming a fifth ground part. The ground upper layer substrate, inner layer substrate, and lower layer substrate are laminated. The first ground part and third ground part are electrically connected. The second ground part and fourth ground part are electrically connected. The antenna device further includes: a chip antenna disposed on the ground upper layer substrate, transmitting and receiving electromagnetic waves; and an adjustment component electrically connecting the first ground part and second ground part, and adjusting antenna characteristics.

10 Claims, 8 Drawing Sheets

(56) References Cited

U.S. PATENT DOCUMENTS

| | | | | |
|---|---|---|---|---|
| 2009/0058733 | A1 | 3/2009 | Kurashima et al. | |
| 2012/0212384 | A1* | 8/2012 | Kam | H01Q 1/2283 343/767 |
| 2014/0145883 | A1* | 5/2014 | Baks | H01Q 1/2283 343/700 MS |

FOREIGN PATENT DOCUMENTS

| | | |
|---|---|---|
| JP | 2004-146978 | 5/2004 |
| JP | 2004-241803 | 8/2004 |
| JP | 2005-229212 | 8/2005 |
| WO | 2007/138959 | 12/2007 |

* cited by examiner

ANTENNA DEVICE AND ELECTRONIC DEVICE

BACKGROUND OF THE INVENTION

1. Field of the Invention

The present disclosure relates to an antenna device and an electronic device including the antenna device.

2. Description of the Related Art

Electronic devices which receive wireless signals by using wireless communications and perform signal processing on the received wireless signals have become increasingly popular. Antenna devices receiving wireless signals are proposed in various shapes and arrangements (for example, refer to Patent Literature 1).

CITATION LIST

Patent Literature

PTL 1: Unexamined. Japanese Patent Publication No. 2004-241803

SUMMARY OF THE INVENTION

As the electronic device is downsized, a size of an antenna device is more limited. This results in degradation of antenna sensitivity of the antenna device.

An antenna device according to the present disclosure includes: a ground upper layer substrate of a dielectric substrate forming a first ground part and a second ground part disposed at a predetermined distance from the first ground part; a ground lower layer substrate of a dielectric substrate forming a third ground part and a fourth ground part disposed at a predetermined distance from the third ground part; and an inner layer substrate of a dielectric substrate forming a fifth ground part. The ground upper layer substrate, the inner layer substrate, and the lower layer substrate are laminated in this order, the first ground part and the third ground part are electrically connected, and the second ground part and the fourth ground part are electrically connected. The antenna device according to the present disclosure further includes: a chip antenna disposed on the ground upper layer substrate, transmitting and receiving an electromagnetic wave; and an adjustment component electrically connecting the first ground part and the second ground part, and adjusting an antenna characteristic.

The present disclosure provides the antenna device which maintains high gain of antenna sensitivity of the antenna device even if a size of the electronic device is small, and the electronic device including the antenna device.

DETAILED DESCRIPTION OF THE PREFERRED EMBODIMENT

An exemplary embodiment will be described in detail below with reference to the drawings as needed. However, a description that is more detailed than necessary may be omitted. For example, a detailed description of an already well-known item and a repeated description of substantially identical components may be omitted. This is for avoiding the following description from becoming unnecessarily redundant and for king the description easier for a person skilled in the art to understand.

It is to be noted that the accompanying drawings and the following description are provided in order for a person skilled in the art to fully understand the present disclosure, and are not intended to limit the subject described in the appended claims.

First Exemplary Embodiment

As an electronic device is downsized, a size of an antenna device is more limited. This results in degradation of antenna sensitivity of the antenna device.

Furthermore, sharing a ground of the antenna device with a ground of another circuit leads to degradation of antenna sensitivity of the antenna device.

The present disclosure provides an antenna device which maintains high gain of antenna sensitivity of the antenna device, even if the size of the electronic device is small.

A first exemplary embodiment will be described below with reference to FIGS. 1 to 10.

Figure 1:
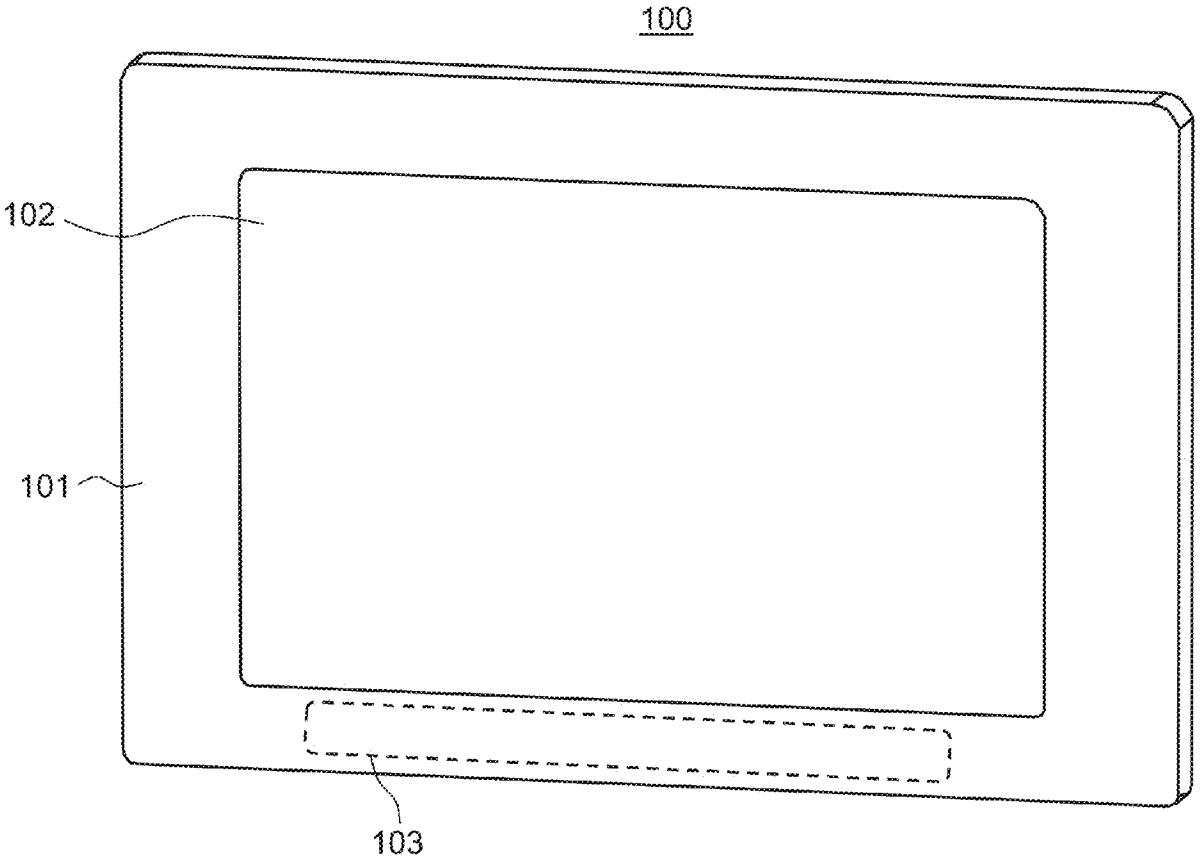
FIG. 1 is a perspective view of an electronic device according to a first exemplary embodiment.

FIG. 1 is a perspective view of an electronic device according to the first exemplary embodiment. The size of the electronic device according to the present exemplary embodiment is 13 inches, for example. As illustrated in FIG. 1, Liquid Crystal Display (LCD) panel 102 is accommodated inside an exterior case formed of front panel 101 and an unillustrated back cover of electronic device 100. Antenna device 103 according to the present exemplary embodiment is accommodated in a lower part of LCD panel 102 inside the exterior case.

Figure 2:
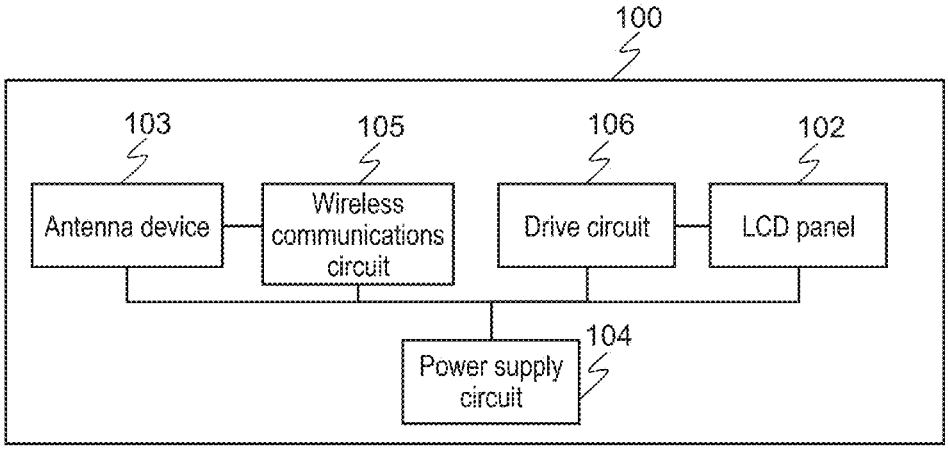
FIG. 2 is a block diagram of the electronic device according to the first exemplary embodiment.

FIG. 2 is a block diagram of the electronic device according to the first exemplary embodiment. Electronic device 100 includes LCD panel 102, antenna device 103, power supply circuit 104, wireless communications circuit 105, and drive circuit 106.

Antenna device 103 receives a wireless signal specified by, for example, Bluetooth (registered trademark), which is one of wireless communications standards.

Power supply circuit 104 supplies power-supply voltages to LCD panel 102, antenna device 103, wireless communications circuit 105, and drive circuit 106.

Wireless communications circuit 105 performs predetermined signal processing on the wireless signal received by antenna device 103.

Drive circuit 106 drives LCD panel 102 to display video signals on LCD panel 102.

Figure 3:
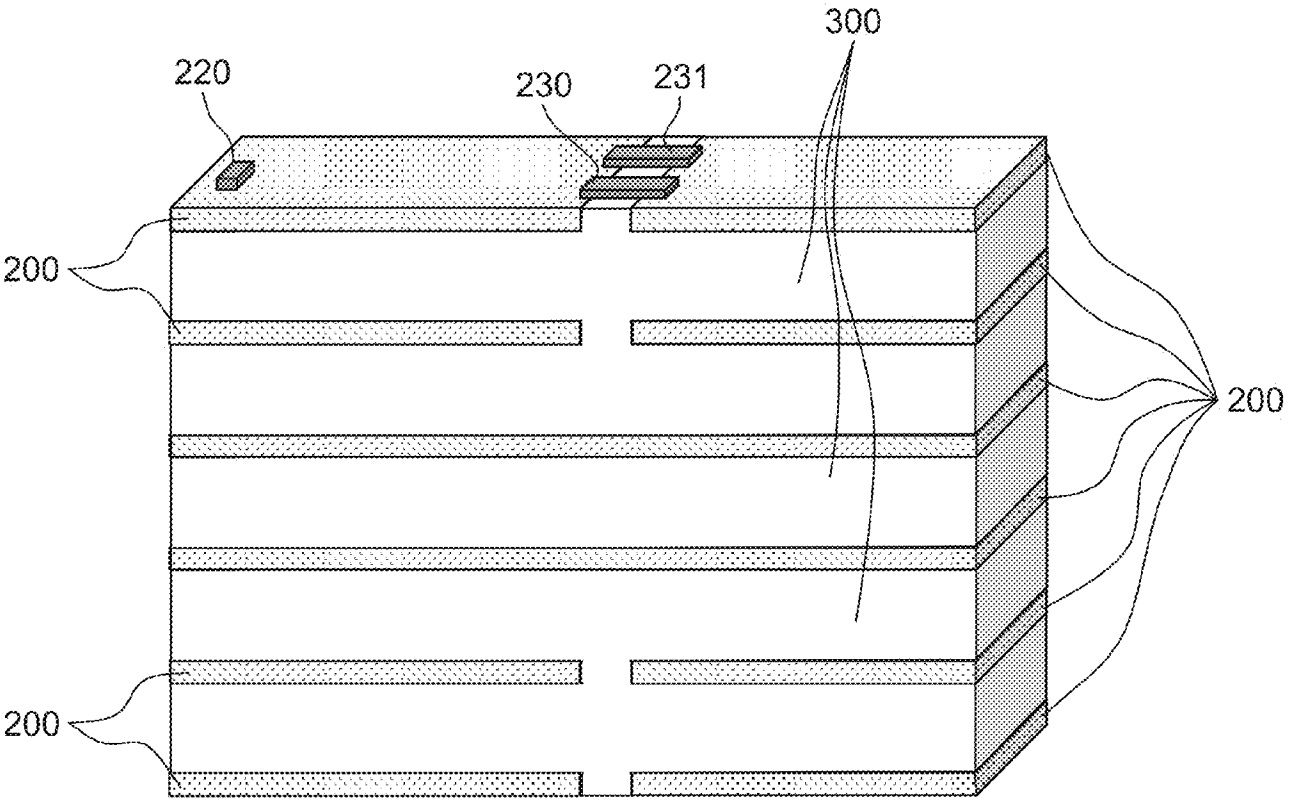
FIG. 3 is a perspective view of an antenna device according to the first exemplary embodiment.

FIG. 3 is a perspective view illustrating a configuration of the antenna device according to the first exemplary embodiment. As illustrated in FIG. 3, antenna device 103 is a multilayer substrate in which six-layer dielectric substrates 200 are laminated. Dielectric 300 fills space between two adjacent dielectric substrates 200. The layers of the multilayer substrate are defined, from top, as a first layer, a second layer, a third layer, a fourth layer, a fifth layer, and a sixth layer. Each of the first layer, the second layer, the fifth layer, and the sixth layer is formed of two dielectric substrates 200. Chip antenna 220 which transmits and receives an electromagnetic wave is disposed on dielectric substrate 200 of the first layer. Furthermore, adjustment components 230 and 231 are disposed on dielectric substrate 200 of the first layer.

Figure 4:
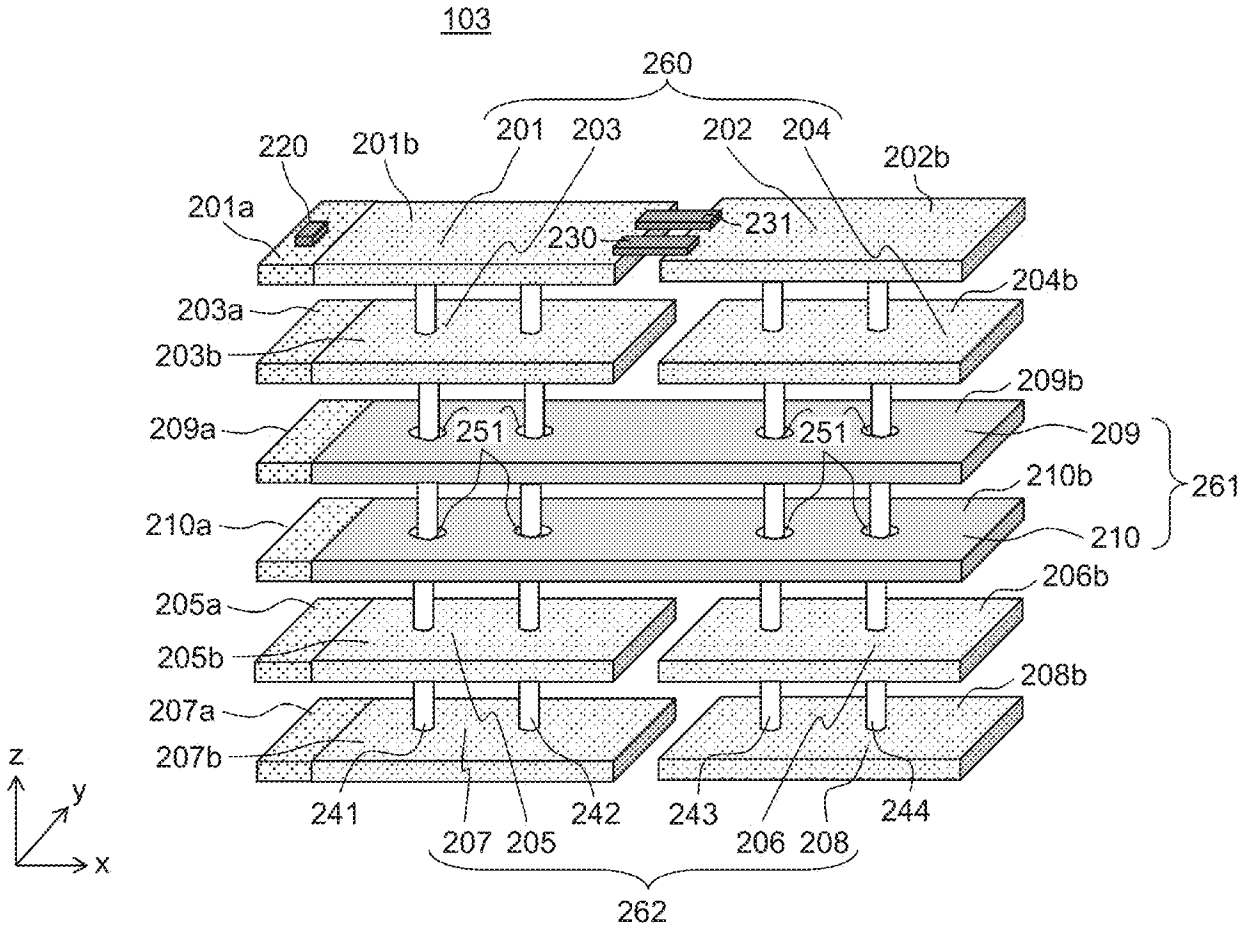
FIG. 4 is a schematic view of the antenna device according to the first exemplary embodiment.

FIG. 4 is a schematic view of the antenna device according to the first exemplary embodiment. In FIG. 4, in order to describe structure of antenna device 103 in detail, dielectric 300 is removed from antenna device 103 of FIG. 3. As illustrated in FIG. 4, the multilayer substrate of antenna device 103 includes ground upper layer substrate 260 including dielectric substrates 201, 202, 203, and 204, inner layer substrate 261 including dielectric substrates 209 and 210, and ground lower layer substrate 262 including dielectric substrates 205, 206, 207, and 208.

Non-ground part 201*a* and first ground part 201*b* are formed in dielectric substrate 201.

Second ground part 202*b* is formed in dielectric substrate 202.

Non-ground part 203*a* and first ground part 203*b* are formed in dielectric substrate 203.

Second ground part 204*b* is formed in dielectric substrate 204.

Non-ground part 205*a* and third ground part 205*b* are formed in dielectric substrate 205.

Fourth ground part 206*b* is formed in dielectric substrate 206.

Non-ground part 207*a* and third ground part 207*b* are formed in dielectric substrate 207.

Fourth ground part 208*b* is formed in dielectric substrate 208.

Non-ground part 209*a* and fifth ground part 209*b* are formed in dielectric substrate 209.

Non-ground part 210*a* and fifth ground part 210*b* are formed in dielectric substrate 210.

Chip antenna 220 is disposed on non-ground part 201*a*.

Non-ground parts 201*a*, 203*a*, 209*a*, 210*a*, 205*a*, and 207*a* are formed so that positions of horizontal plane, that is, xy positions in FIG. 4 are identical.

Each of adjustment components 230 and 231 connects first ground part 201*b* and second ground part 202*b*. Each of adjustment components 230 and 231 includes components such as a coil, a capacitor, a resistor, and a bead. The components of adjustment components 230 and 231 are selected in accordance with a desired frequency and a desired antenna characteristic of antenna device 103.

First ground parts 201*b* and 203*b* are electrically connected to third ground parts 205*b* and 207*b* through VIAs 241 and 242.

Second ground parts 202*b* and 204*b* are electrically connected to fourth ground parts 206*b* and 208*b* through VIAs 243 and 244.

In fifth ground part 209*b*, four through holes 251 are formed to penetrate VIAs 241, 242, 243, and 244 respectively.

Ground upper layer substrate 260 and ground lower layer substrate 262 are used as a ground for chip antenna 220. Inner layer substrate 261 is used as a ground for wireless-communications circuit 105 and other circuits other than antenna device 103. Such a configuration allows isolation between the ground for antenna device 103 and the ground for the other circuits without sharing the ground.

Figure 5:
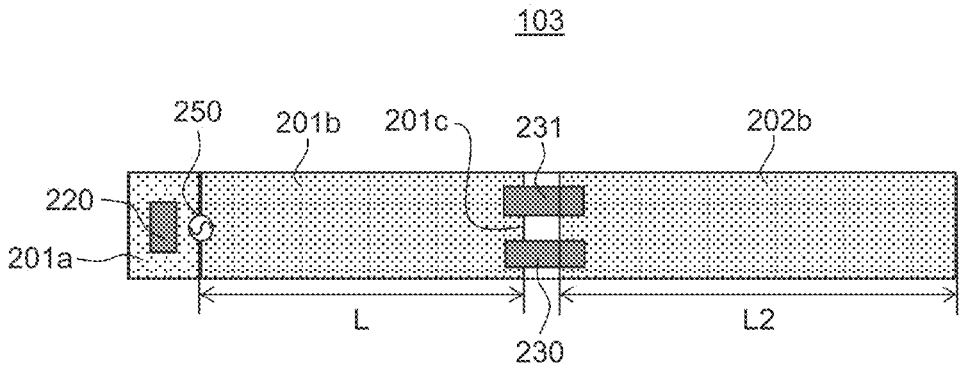
FIG. 5 is a top view of the antenna device according to the first exemplary embodiment.

Next, adjustment of antenna characteristics of antenna device 103 will be described. FIG. 5 is a top view of the antenna device according to the first exemplary embodiment.

As illustrated in FIG. 5, it is assumed that a length along a longitudinal direction of first ground part 201*b* is a length L. That is, the length L is a length from feeding point 250 at a boundary position between non-ground part 201*a* and first ground part 201*b* to edge end 201*c* on an opposite side of dielectric substrate 201.

The antenna characteristics of antenna device 103 are adjusted by a component configuration of adjustment components 230 and 231, and adjustment of the length L.

A length L2 of second ground part 202*b* preferably satisfies $\lambda/4 \leq L2 \leq \lambda/16$.

Figure 6:
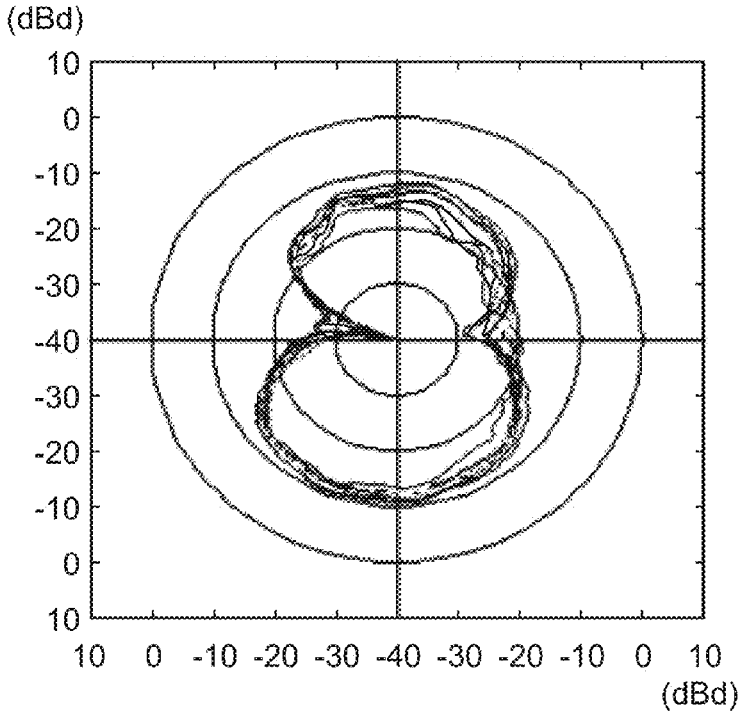
FIG. 6 is a graph illustrating antenna characteristics of vertical polarization of the antenna device according to the first exemplary embodiment.
Figure 7:
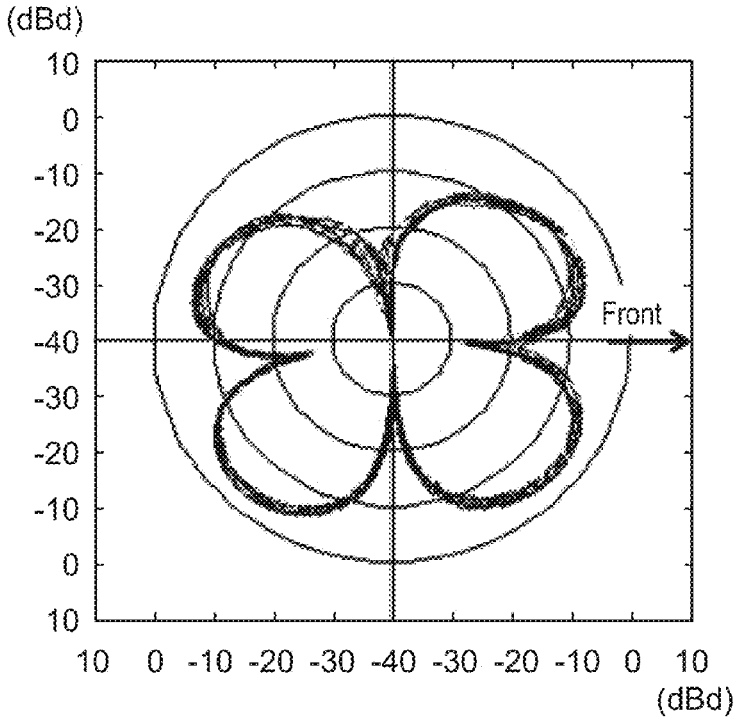
FIG. 7 is a graph illustrating antenna characteristics of horizontal polarization of the antenna device according to the first exemplary embodiment.
Figure 8:
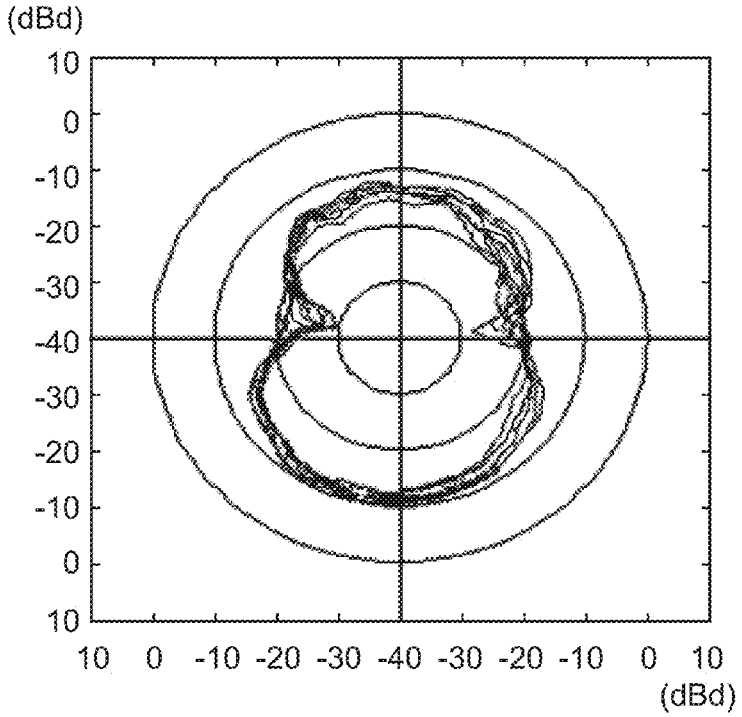
FIG. 8 is a graph illustrating other antenna characteristics of vertical polarization of the antenna device according to the first exemplary embodiment.
Figure 9:
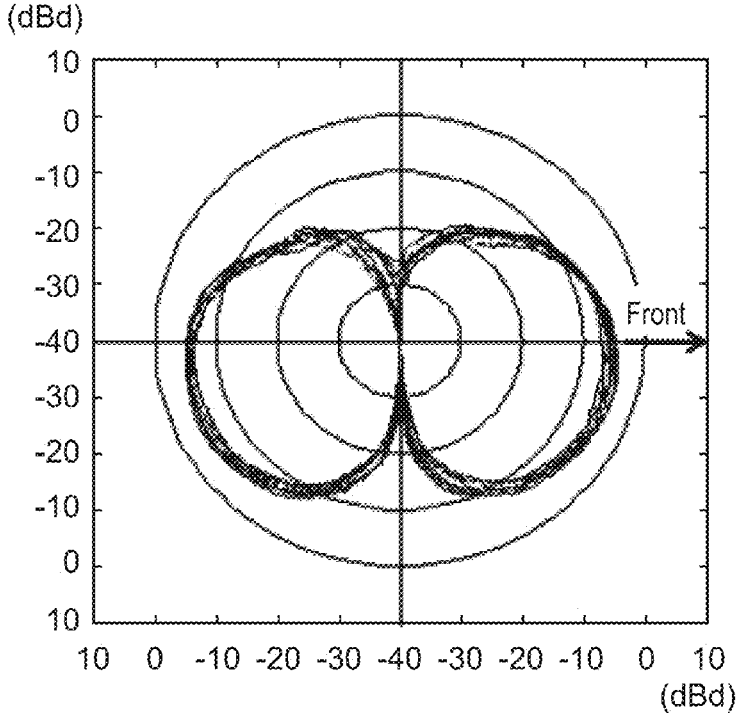
FIG. 9 is a graph illustrating other antenna characteristics of horizontal polarization of the antenna device according to the first exemplary embodiment.

Next, adjustment of the length L will be described with reference to FIGS. 6 to 8. It is assumed that a wavelength of a signal which antenna device 103 receives is $\lambda$. The antenna characteristics of antenna device 103 are measured in cases where the length L is $\lambda/2$ and $\lambda/4$. FIGS. 6 and 7 are diagrams illustrating the antenna characteristics in the case where the length L is $\lambda/2$, whereas FIGS. 8 and 9 are diagrams illustrating the antenna characteristics in the case where the length L is $\lambda/4$. FIGS. 6 and 8 are graphs illustrating the antenna characteristics of vertical polarization of antenna device 103, whereas FIGS. 7 and 9 are graphs illustrating the antenna characteristics of horizontal polarization of antenna device 103. In FIG. 6 to FIG. 9, frequencies of antenna device 103 are nine frequencies at intervals of 10 MHz between 2400 MHz and 248 MHz. In FIG. 6 to FIG. 9, each of vertical axes and horizontal axes represents a gain (dBd) which is intensity of energy at a radiation angle.

A change of the antenna characteristics of vertical polarization of antenna device 103 in FIG. 6 and the antenna characteristics of vertical polarization of antenna device 103 in FIG. 8 is little. A change of the antenna characteristics of horizontal polarization of antenna device 103 in FIG. 7 and the antenna characteristics of horizontal polarization of antenna device 103 in FIG. 9 is big. At a front of antenna device 103, the gain in FIG. 9 in which the length L is $\lambda/4$ is higher than the gain in FIG. 7 in which the length L is $\lambda/2$. Accordingly, adopting the length L of $\lambda/4$ improves the antenna characteristics.

Figure 10:
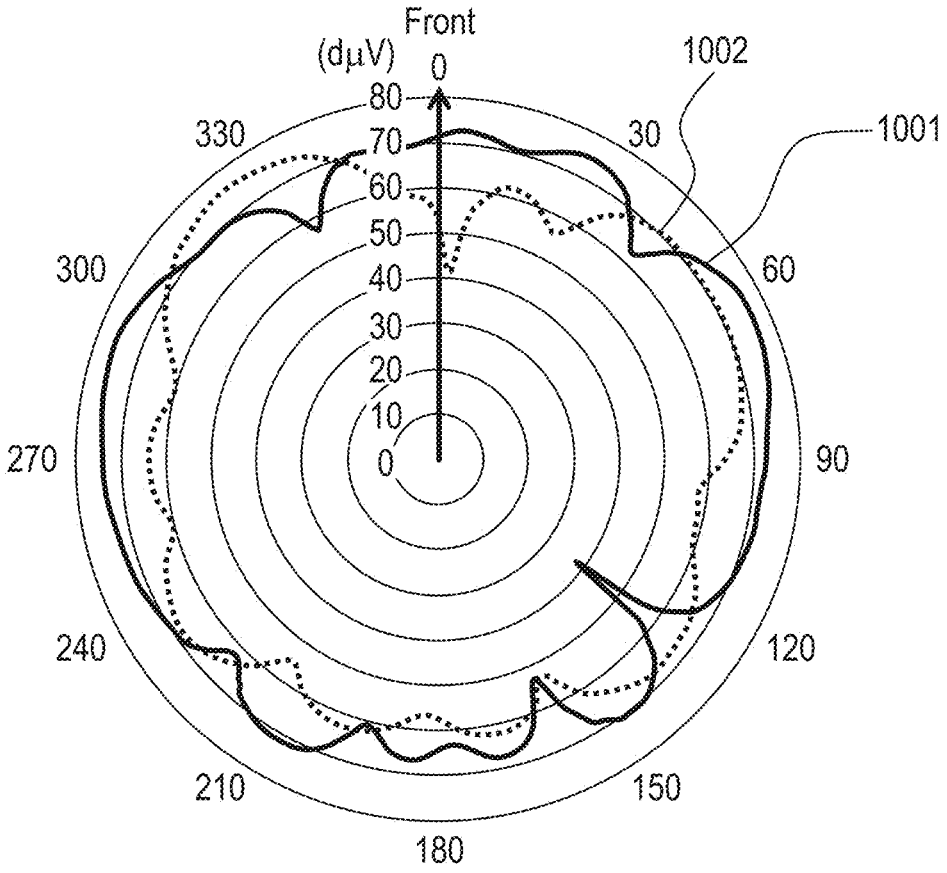
FIG. 10 is a graph illustrating a transmission voltage of the electronic device according to the first exemplary embodiment and a transmission voltage of a conventional electronic device.

Next, a transmission voltage of electronic device 100 is measured. FIG. 10 is a graph illustrating a transmission voltage of electronic device 100 according to the present exemplary embodiment and a transmission voltage of a conventional electronic device. FIG. 10 illustrates a case where the frequency is 2450 MHz. A result of measurement obtained when the frequency is from 2400 MHz to 2480 MHz is generally identical to a result of measurement obtained, when the frequency is 2450 MHz. In FIG. 10, result 1001 illustrates the transmission voltage of electronic device 100 according to the present exemplary embodiment, whereas result 1002 illustrates the transmission voltage of the conventional electronic device. In FIG. 10, at the front of the electronic device, the transmission voltage of result 1001 is improved compared with the transmission voltage of result 1002. Because of reversibility, reception sensitivity of electronic device 100 is also improved.

As described above, the antenna device according to the present disclosure includes a ground upper layer substrate of a dielectric substrate forming a first ground part and a second ground part disposed at a predetermined distance from the first ground part, the ground lower layer substrate of a dielectric substrate forming a third ground part and a fourth ground part disposed at a predetermined distance from the third ground part, and the inner layer substrate of a dielectric substrate forming a fifth ground part. The ground upper layer substrate, the inner layer substrate, and the lower layer substrate are laminated in this order. The first ground part and the third ground part are electrically connected, and the second ground part and the fourth ground part are electrically connected. The antenna device according to the present disclosure further includes the chip antenna disposed on the ground upper layer substrate, transmitting and receiving an electromagnetic wave, and the adjustment component electrically connecting the first ground part and the second ground part, and adjusting an antenna characteristic.

This configuration makes it possible to provide the antenna device which maintains high gain of antenna sensitivity of the antenna device even if the size of the electronic device is small.

Although antenna device 103 is a multilayer substrate ire which six-layer dielectric substrates 200 are laminated in the description of the present exemplary embodiment, the present exemplary embodiment is not limited to this example. In addition, although each of ground upper layer substrate 260, inner layer substrate 261, and ground lower layer substrate 262 of antenna, device 103 is made of two-layer dielectric substrates in the description of the present exemplary embodiment, the present exemplary embodiment is not limited to this example. Each substrate may be made of at least one-layer dielectric substrate.

Although there are four VIAs in the description of the present exemplary embodiment, the VIAs are not limited to this example.

What is claimed is:

1. An antenna device comprising:

a ground upper layer substrate of a dielectric substrate forming a first ground element and a second ground element disposed at a predetermined distance from the first ground element;

a ground lower layer substrate of a dielectric substrate forming a third ground element and a fourth ground element disposed at a predetermined distance from the third ground element;

an inner layer substrate of a dielectric substrate forming a fifth ground element;

a chip antenna disposed on the ground upper layer substrate, transmitting and receiving an electromagnetic wave; and an adjustment component electrically connecting the first ground element and the second ground element, and adjusting an antenna characteristic, wherein the ground upper layer substrate, the inner layer substrate, and the lower layer substrate are laminated in this order, the first ground element and the third ground element are electrically connected by a first conductive via, the second ground element and the fourth ground element are electrically connected by a second conductive via, the first ground element and the second ground element are formed in the same layer and are non-contiguous with one another, and the fifth ground element is not electrically connected to any one of the first ground element, the second ground element, the third ground element, and the fourth ground element.

2. The antenna device according to claim 1, wherein a length in a longitudinal direction of the first ground element is ¼ of a wavelength of the electromagnetic wave the chip antenna receives.

3. The antenna device according to claim 1, wherein a length in a longitudinal direction of the second ground element is between ¼ and 1/16 inclusive of a wavelength of the electromagnetic wave the chip antenna receives.

4. An electronic device comprising:

the antenna device, according to claim 1, transmitting and receiving a wireless signal; and a wireless communications circuit applying predetermined signal processing to the wireless signal.

5. The antenna device of claim 1, wherein the third ground element and the fourth ground element are formed in the same layer and are non-contiguous with one another.

6. The antenna device of claim 1, wherein the predetermined distance between the first ground element and the second ground element is taken along the longitudinal axis of the ground upper layer substrate.

7. The antenna device of claim 1, wherein the predetermined distance between the third ground element and the fourth ground element is taken along the longitudinal axis of the ground lower layer substrate.

8. The antenna device of claim 1, wherein the first conductive via and the second conductive via are separated by a material having a composition which is different from the composition of a material forming the first conductive via and the second conductive via.

9. The antenna device of claim 1, wherein the chip antenna, the first ground element, the adjustment component, and the second ground component are disposed in this order along a longitudinal axis of the ground upper layer substrate.

10. The antenna device of claim 1, wherein the adjustment component comprises at least one of a coil, a capacitor, a resistor and a bead.

* * * * *